US006253720B1

(12) United States Patent
Lancefield et al.

(10) Patent No.: US 6,253,720 B1
(45) Date of Patent: Jul. 3, 2001

(54) VARIABLE PHASE COUPLING

(75) Inventors: Timothy Mark Lancefield, Bicester; Ian Methley, Witney, both of (GB)

(73) Assignee: Mechadyne PLC, Kirtlington (GB)

( * ) Notice: Subject to any disclaimer, the term of this patent is extended or adjusted under 35 U.S.C. 154(b) by 0 days.

(21) Appl. No.: 09/711,351

(22) Filed: Nov. 9, 2000

Related U.S. Application Data

(62) Division of application No. 09/463,751, filed as application No. PCT/GB98/02153 on Jul. 28, 1998.

(30) Foreign Application Priority Data

Jul. 30, 1997 (GB) ..... 9715974

(51) Int. Cl.[7] ..... F01L 1/344

(52) U.S. Cl. ..... 123/90.17; 74/568 R; 464/2; 464/160

(58) Field of Search ..... 123/90.15, 90.17, 123/90.31; 74/568 R; 464/1, 2, 160, 161

(56) References Cited

U.S. PATENT DOCUMENTS

| | | | | |
|---|---|---|---|---|
| 2,197,155 | | 4/1940 | Nardone | 74/459 |
| 3,807,243 | * | 4/1974 | Yada | 74/63 |
| 5,078,647 | * | 1/1992 | Hampton | 464/1 |
| 5,152,263 | | 10/1992 | Danieli | 123/90.17 |
| 5,172,661 | * | 12/1992 | Brune et al. | 123/90.17 |
| 5,172,662 | * | 12/1992 | Hampton | 123/90.17 |
| 5,219,313 | * | 6/1993 | Danieli | 464/2 |
| 5,803,030 | * | 9/1998 | Cole | 123/90.17 |

FOREIGN PATENT DOCUMENTS 0 723 094 7/1996 (EP) .

* cited by examiner

*Primary Examiner*—Weilun Lo
(74) *Attorney, Agent, or Firm*—Smith-Hill and Bedell

(57) ABSTRACT

A variable phase coupling for connecting a crankshaft to a camshaft comprises a drive member for connection to the crankshaft having helical grooves of a first pitch, a driven member for connection to the engine camshaft having helical grooves of a different pitch facing towards the grooves in the drive member, an intermediate member disposed between the drive and driven members having helical grooves on its inner and outer surfaces, a first set of balls engaging in the pairs of helical grooves comprising the helical grooves in the driven member and the facing grooves on one surface of the intermediate member, a second set of balls engaging in the pairs of helical grooves that comprise the grooves in the drive member and the facing grooves on the other surface of the intermediate member, and means for axially displacing the intermediate member relative to the drive and driven members. The displacement of the intermediate member serves to move the balls relative to the helical grooves in the drive and the driven members so as to vary the phase between the drive and driven members. The helical grooves in each pair have the same pitch as one another and, in order to reduce backlash, the intermediate member is radially compliant and exerts a slight clamping force on the balls.

2 Claims, 5 Drawing Sheets

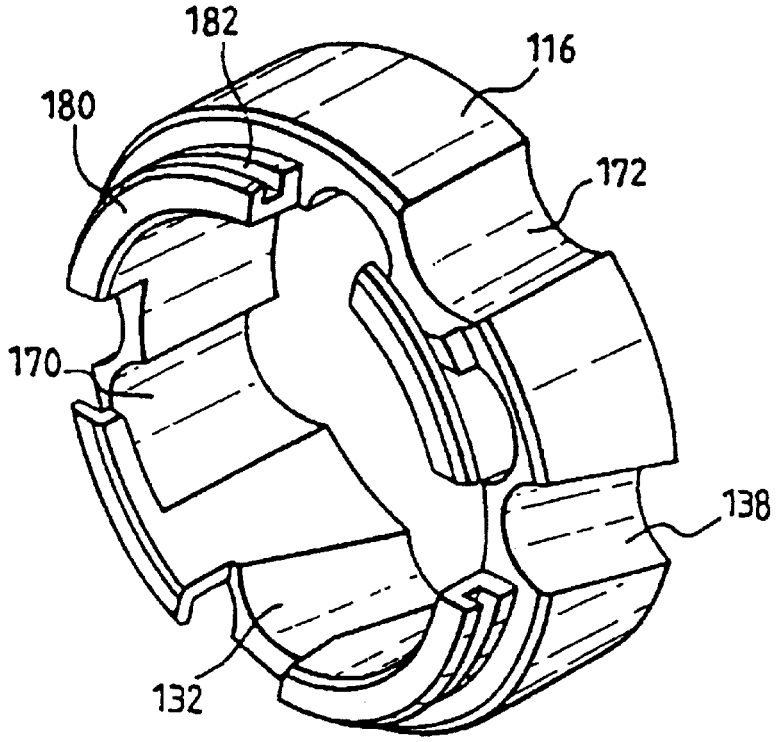
Fig. 9
Fig. 10
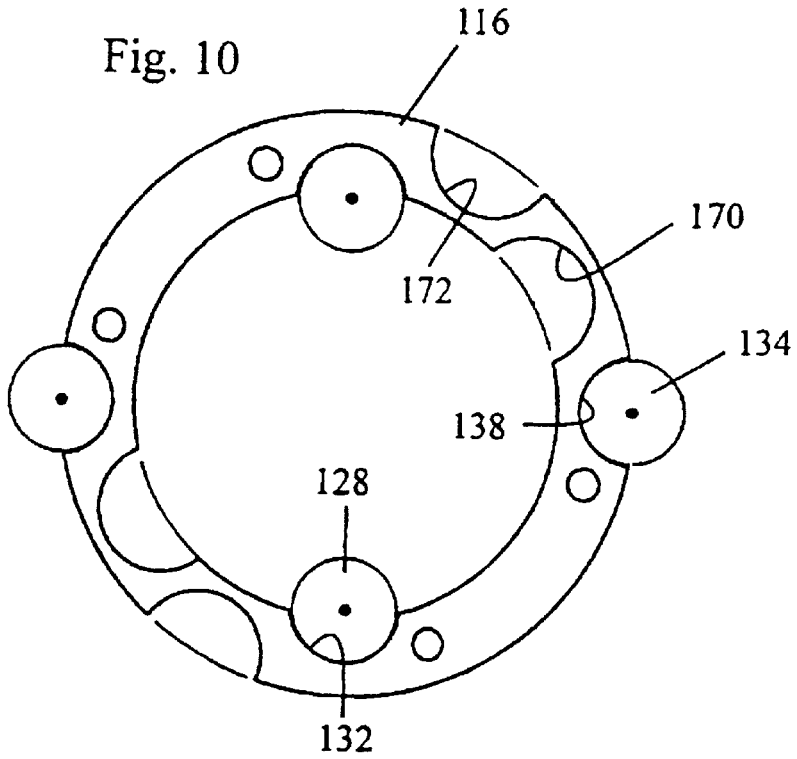

VARIABLE PHASE COUPLING

CROSS-REFERENCE TO RELATED APPLICATION

This application is filed as a divisional of patent application Ser. No. 09/463,751 filed Jan. 28, 2000 which is a 371 of PCT/GB98/02153 filed Jul. 28, 1998.

FIELD OF THE INVENTION

The present invention relates to a variable phase coupling.

BACKGROUND OF THE INVENTION

The optimum angles at which the inlet and exhaust valves of an internal combustion engine should open and close, both in relation to one another and in relation to the engine crankshaft, vary with the engine speed and load conditions. In an engine with a fixed valve timing, a compromise setting must be adopted in which different performance parameters are traded off one against the other.

To achieve improved performance over a range of engine speeds and loads, it has already been proposed to use variable phase couplings to vary the phase of a camshaft in relation to the crankshaft and in relation to another camshaft.

Several variable phase couplings are known from the prior art, each having its own advantages and disadvantages. Noise and wear are particularly serious common problems that are caused by the fact that camshafts are subjected to torque reversal during operation. While a valve is being opened by a cam on the camshaft, torque has to be applied to the camshaft in one direction to overcome the resistance of the valve spring. On the other hand, while a valve is closing, its spring attempts to accelerate the camshaft and the camshaft experiences a torque reaction from the valve train acting in the opposite direction.

A further problem with some known designs is that they cannot be retro-fitted to an existing engine because they require major modification to the engine block, cylinder head or valve train.

EP-A-0723094, which is believed to represent the closest prior art to the present invention, discloses a variable phase coupling for adjusting the phase between first and second rotatable members that addresses many of the above problems. The coupling comprises a first rotatable member within which there is coaxially mounted a second rotatable member, the two rotatable members being relatively axially displaceable with respect to one another. Helical grooves are formed on an inner cylindrical surface of the first rotatable member and on the outer cylindrical surface of the second rotatable member. Balls that are held in position relative to one another by means of a cage are engaged in the helical grooves of the two members. Adjustment means are provided for bringing about a phase change by causing relative axial displacement of the first and second rotatable members.

The second rotatable member may be formed as an intermediate cylinder or sleeve between an inner rotatable shaft and the first rotatable member, the inner rotatable shaft and the intermediate cylinder or sleeve being coupled for rotation together by a coupling with allows relative axial displacement thereof, or the first rotatable member may be formed as an intermediate sleeve or cylinder between the second rotatable member and an outer rotatable member, the outer rotatable member and the intermediate cylinder being coupled for rotation together by a coupling which allows relative axial displacement thereof.

In EP-A-0723094, the coupling between the intermediate member and one of the inner rotatable shaft or the outer rotatable member, that is to say one of the drive and driven members, is by means of axial grooves which simply allow the intermediate member to move axially without bringing about any relative phase shift. Furthermore, it is essential in this earlier proposal to use cages for each set of balls.

OBJECT OF THE INVENTION

The present invention seeks to provide a variable phase coupling that can be retro-fitted to an engine and that is robust and quiet in operations.

SUMMARY OF THE INVENTION

According to the present invention, there is provided a variable phase coupling for connecting a crankshaft to a camshaft, the coupling comprising a drive member for connection to the crankshaft having helical grooves of a first pitch, a driven member for connection to the engine camshaft having helical grooves of a different pitch facing towards the grooves in the drive member, an intermediate member disposed between the drive and driven members having helical grooves on its inner and outer surface, a first set of balls engaging in the pairs of helical grooves comprising the helical grooves in the driven member and the facing grooves on one surface of the intermediate member, a second set of balls engaging in the pairs of helical grooves that comprise the grooves in the drive member and the facing grooves on the other surface of the intermediate member, and means for axially displacing the intermediate member relative to the drive and driven members, the displacement of the intermediate member serving to move the balls relative to the helical grooves in the drive and driven members so as to vary the phase between the drive and driven members, wherein the helical grooves in each pair have the same pitch as one another and, in order to reduce backlash, the intermediate member is radially compliant and exerts a slight clamping force on the balls.

The fact that all the grooves are helical means that for a given degree of phase change, a smaller axial displacement of the intermediate member is required to bring about a given change of phase. In this respect, it is preferred that the helical grooves in the drive and driven members should have the same helical angle but opposite pitch.

A serious limitation of the proposal in EP-A-0723094 is the requirement for cages and absence of means for limiting or avoiding backlash. In order to suppress the noise resulting from torque reversal in the prior art, it is necessary either to make the couplings very accurately or to employ some form of active backlash control. Such active backlash control conventionally contributes to an increase in sliding friction and increases the force required to bring about a change in phase. As a result, it is necessary to resort to a larger actuator and, if a hydraulic actuator is used, this also means a slower response because of the small diameter of the drillings in the camshaft that feed oil to the actuator.

The problem of backlash is avoided by forming the intermediate member in such a manner as to exhibit elasticity in the radial direction and thereby exert a slight clamping force on the balls.

BRIEF DESCRIPTION OF THE DRAWING

The invention will now be described further, by way of example, which reference to one embodiment illustrated in the accompanying drawings in which:

FIG. 9 is a perspective view of the intermediate member of the embodiment of FIGS. 7 and 8, and FIG. 10 is a section through the intermediate member of FIG. 9 in a plane normal to the rotational axis of the coupling.

DETAILED DESCRIPTION OF THE PREFERRED EMBODIMENT

Figure 1:
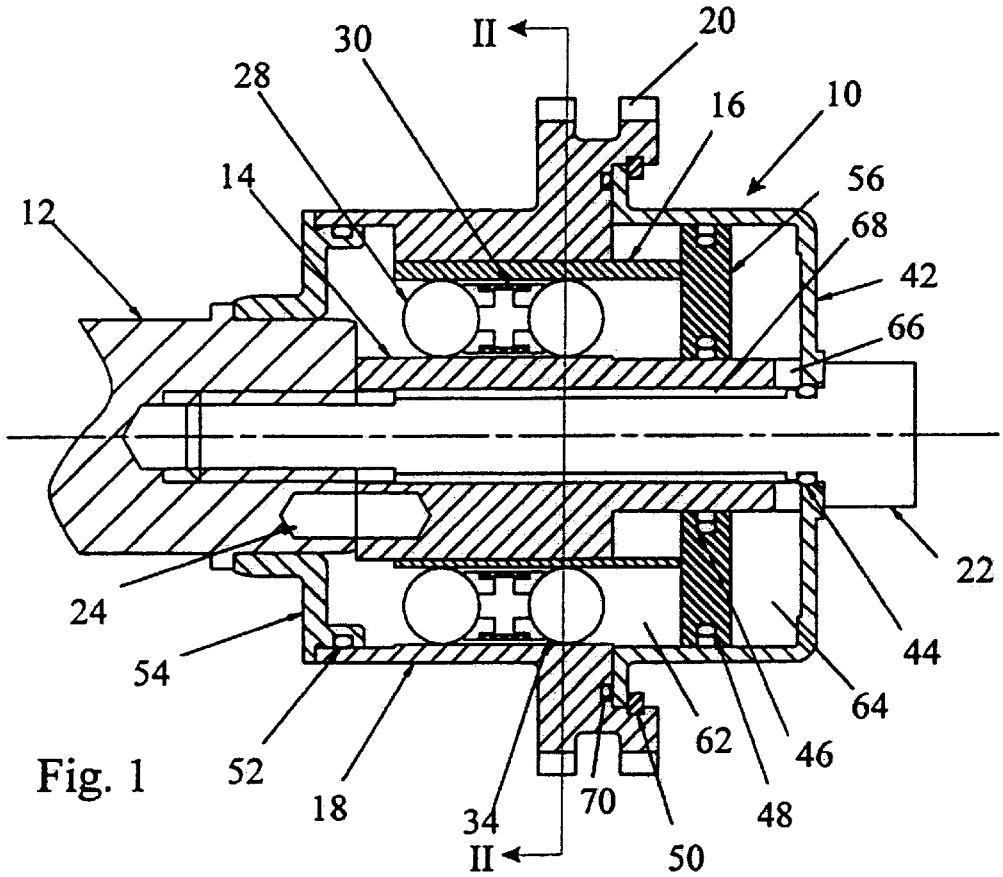
FIG. 1 is a section through a variable phase coupling of the invention taken through a plane containing the axis of rotation but in which the helix angles of the grooves have not been shown for clarity.
Figure 2:
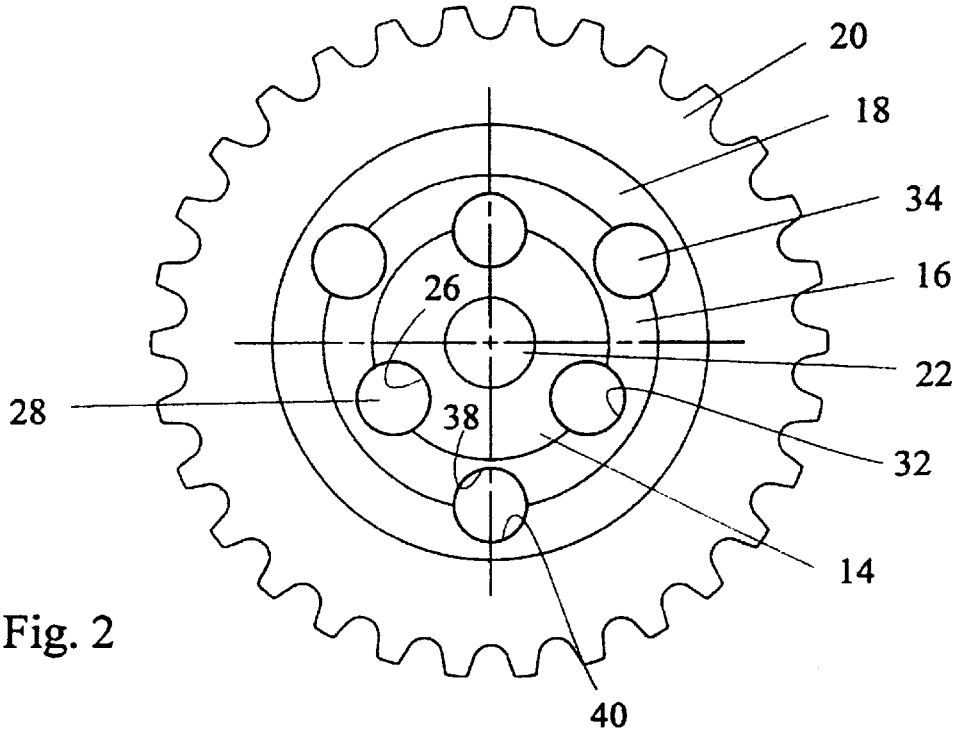
FIG. 2 is a section taken in the place II—II in FIG. 1 normal to the axis of rotation.

FIGS. 1 to 6 show a first embodiment of a variable phase coupling 10 for driving a camshaft 12. The variable phase coupling 10 takes the place of the camshaft drive sprocket or toothed pulley of a conventional engine and requires no modification to the engine other than the provision of a switchable or variable hydraulic feed to control the phase of the drive coupling.

The variable phase coupling 10 comprises three concentric members consisting of an inner driven member 14, an intermediate member 16 and an outer drive member 18, the latter being formed with a sprocket 20 that is driven by the engine crankshaft by way of a chain. The drive 14, intermediate 16 and driven 18 members are each shown more clearly in isometric projection in FIGS. 3, 4 and 5, respectively.

Figure 3:
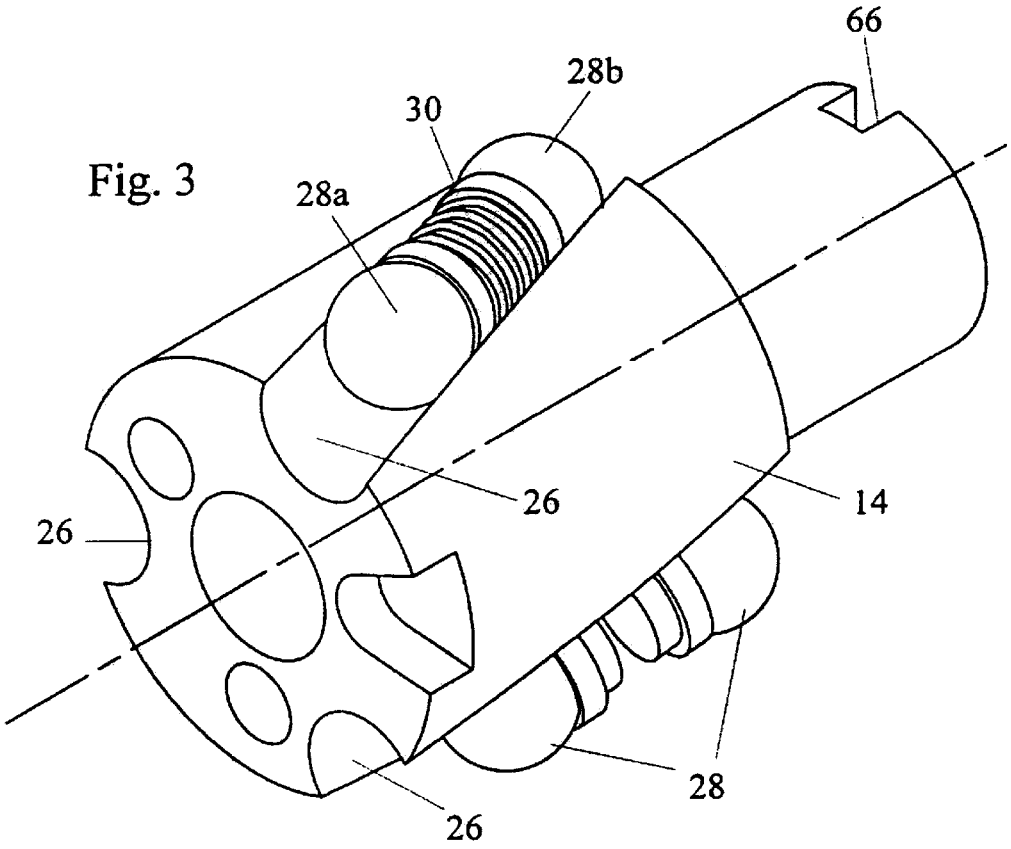
FIG. 3 is an isometric view of the inner driven member together with the balls coupling it for rotation with the intermediate member.

The entire assembly of the variable phase coupling 10 is secured to the camshaft 12 by means of a single central bolt 22 and the inner drive member 14 is prevented from rotating relative to the camshaft 12 by a dowel pin 24. The inner driven member 14 is provided on its cylindrical outer surface with three helical grooves 26 which are shown in FIG. 3. Within each groove 26 there sit two balls 28*a* and 28*b* that are urge apart by a spring 30.

Figure 4:
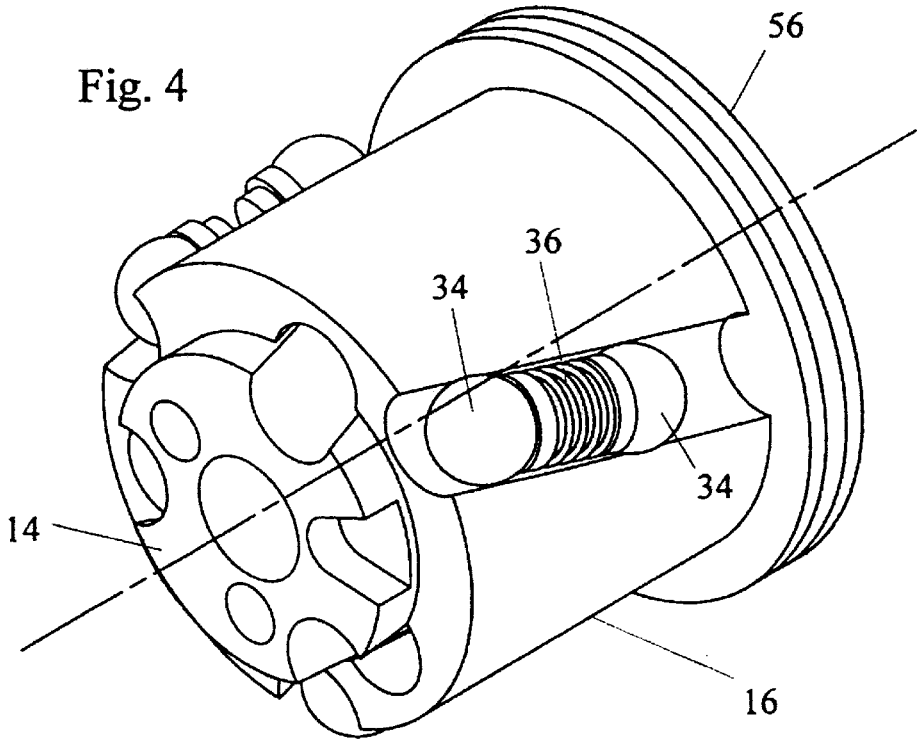
FIG. 4 is an isometric view of the intermediate member and the balls coupling it for rotation with the outer drive member, the inner driven member also being mounted within the intermediate member.
Figure 5:
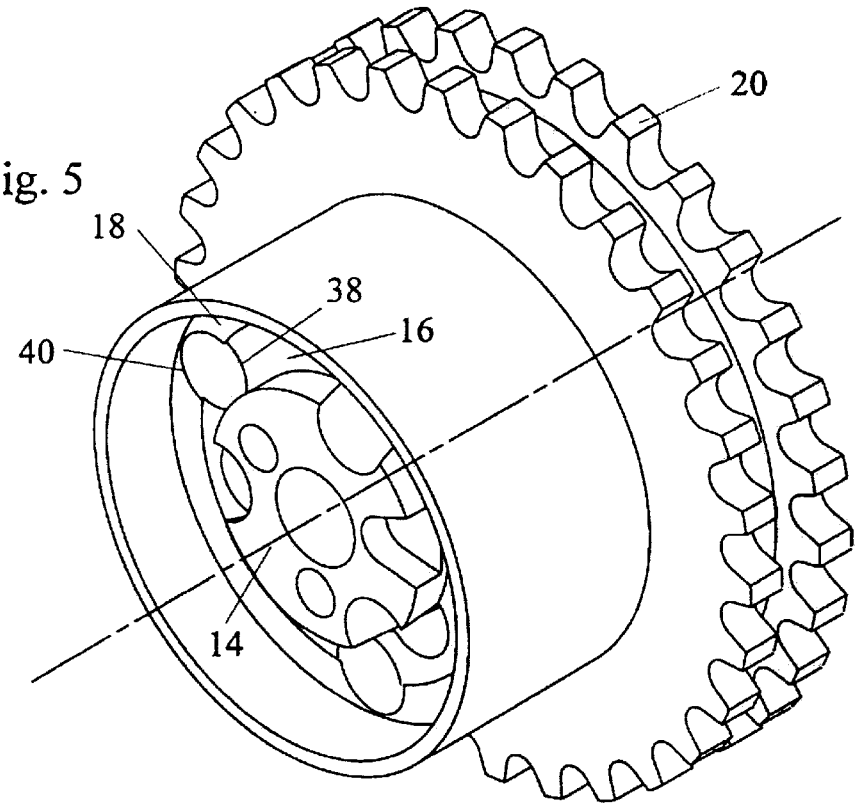
FIG. 5 is an isometric view of the outer drive member when fitted over the intermediate member and the inner driven member.
Figure 6:
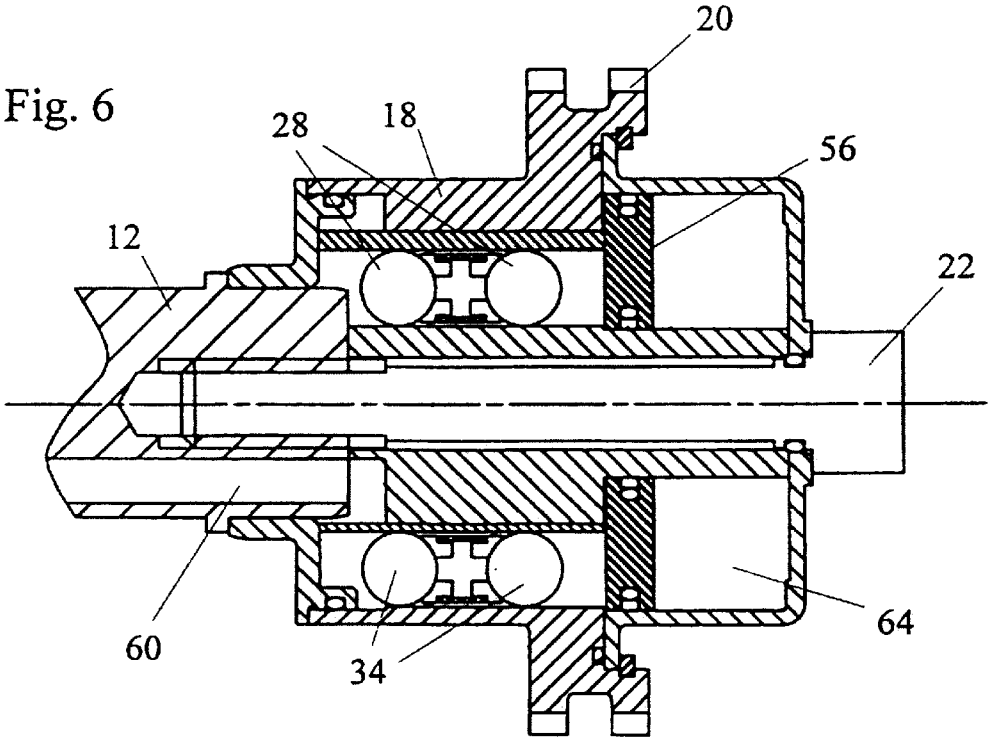
FIG. 6 is a view generally similar to FIG. 1 but showing the intermediate member in its position corresponding to maximum advancement of the phase between the drive and driven members.

The intermediate member 16 that surrounds the inner member 14 (as shown in FIG. 4) has inwardly facing helical grooves 32 that run nearly (but not exactly) parallel to the grooves 26 in the inner driven member 14. The balls 28 also sit within these grooves 32 and as a result they couple the inner driven member 14 and the intermediate member 16 for rotation with one another. However the relative phase between the inner member and the intermediate member will depend on their relative axial position because of the helical angle of the grooves 26 and 32 (which in the interest of clarity has not been shown in FIG. 1).

Because the helical angles of the grooves 26 and 32 are not exactly the same, there will only be at any one time a short length of the grooves 26 and 32 that overlap sufficiently to accommodate the balls 28. The spring 30 acts to push the two balls 28*a* and 28*b* to the limits of this short length, so that the balls between them laterally engage both sides of both grooves at the same time and thereby eliminate any backlash between the two members. The balls 28 in this way enable relative axial movement between the inner and intermediate members 14 and 16, to permit the phase between them to be changed while at the same time ensuring that the members rotate with one another without backlash.

Essentially the same arrangement of balls 34 biased apart by a springs 36 and located between slightly misaligned helical grooves 38 and 40 is used to couple the intermediate member 16 for rotation with the outer drive member 18. The helical angle of the grooves 38 and 40 is, however, of the opposite pitch to the that of the grooves 26 and 32. As a result, with the inner member 14 and the outer member 18 in a fixed relative axial position, axial movement of the intermediate member 16 between the two of them will cause them to shift in phase relative to one another. In all axial positions of the intermediate member 16, the three members 14, 16 and 18 will rotate in unison without any backlash between them.

In the described preferred embodiment of the invention, the axial movement of the intermediate member 16 is effected hydraulically, as will now be described. An end cap 54 is fitted to a cylindrical extension of the outer member 18 and is sealed relative to the latter by means of an O-ring seal 52. A piston housing 42 is secured to the other end of the outer member 18 by means of a circlip 50, the piston housing being sealed by a fixing seal 44 relative to the central fixing bolt 22 and by an O-ring seal 70 relative to the outer drive member 18. An annular piston 56 that forms part of the intermediate member 16 has an inner seal 46 that seals against the inner member 14 and an outer seal 48 to seal against the piston housing.

Passages are formed in the camshaft 12 to supply oil to, and drain oil from, both sides of the piston 56. One of the passages, designated 60 in FIG. 6, communicates with the chamber 62 to left of the piston 56 as viewed, while another passage in the camshaft (not shown) communicates with the chamber to the right of the piston 56, as viewed, by way of a passage 68 defined between the fixing bolt 22 and the inner member 14 and two cut-outs 66 formed in the end of the inner member 14.

In use, the oil supplies to the chambers 62 and 64 are regulated to control the position of the piston 56 and, as explained above, each axial position of the piston 56 corresponds to a given relative phase between the drive member 18 and the driven member 14, that is to say between the crankshaft and the camshaft 12.

The embodiment of the invention shown in FIGS. 7 to 10 is similar in most respects to the embodiment of FIGS. 1 to 6 and differs from it primarily in the manner in which backlash is eliminated. In order to avoid unnecessary repetition of components serving essentially the same function, components of the embodiment of FIGS. 7 to 10 corresponding to components already described have been allocated similar reference numerals but with 100 added to each numeral.

Instead of relying on pairs of balls in helical grooves of slightly different pitch, the embodiment of FIGS. 7 to 10 makes use of an intermediate member 116 that is radially compliant and that can move radially relative to the piston 156. The intermediate member 116, as best shown in FIGS. 9 and 10, has helical grooves 132 and 138 for receiving the balls 128, 134 that couple it to the outer drive member 118 and the inner driven member 114, respectively. In addition to the helical inner and outer grooves 132 and 138 on its inner and outer surface, the intermediate member 116 also has straight grooves 170 and 172 that serve to render the intermediate member 116 radially compliant without preventing it from transmitting torque. Thus, it will be noted in particular that the top left and bottom right quadrants of the intermediate member 116 as shown in FIG. 10 are solid and can transmit torque between the inner and outer set of balls 128, 134, and that the inner and outer grooves 170 and 172 provided to render the intermediate member 116 radially compliant are formed in the other two quadrants.

FIG. 9 also shows the manner in which the intermediate member 116 is coupled for movement with the hydraulic piston 156. The intermediate member 116 has an axial extension 180 formed in its outer surface with a groove 182 that faces radially outwards. The piston 156 has a cylindrical extension with an inner diameter larger than the outer diameter of the extension 180 of the intermediate member that is formed with a groove that faces radially inwards. A spring ring or circlip engages in the two grooves to lock the intermediate member 116 for axial movement with the piston 156, allowing the intermediate member to float radially to take up any tolerance in the various helical grooves.

Figure 7:
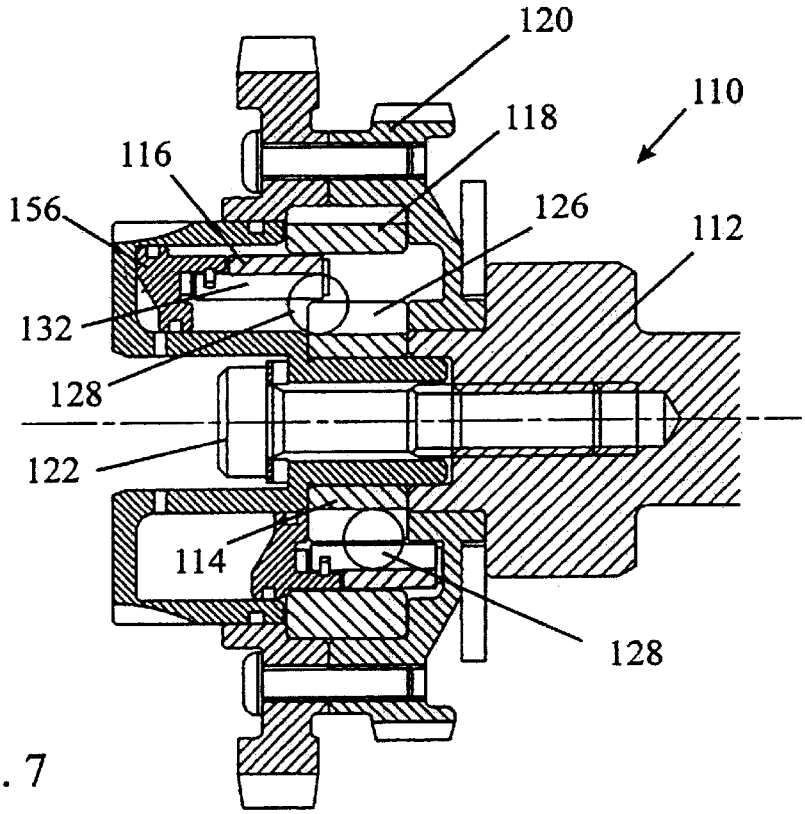
FIG. 7 is an axial section through a variable phase coupling of a second embodiment of the invention using an intermediate member displaying elasticity in the radial direction, the section plane passing through the inner set of balls and showing the balls, the intermediate member and the piston in their extreme positions.
Figure 8:
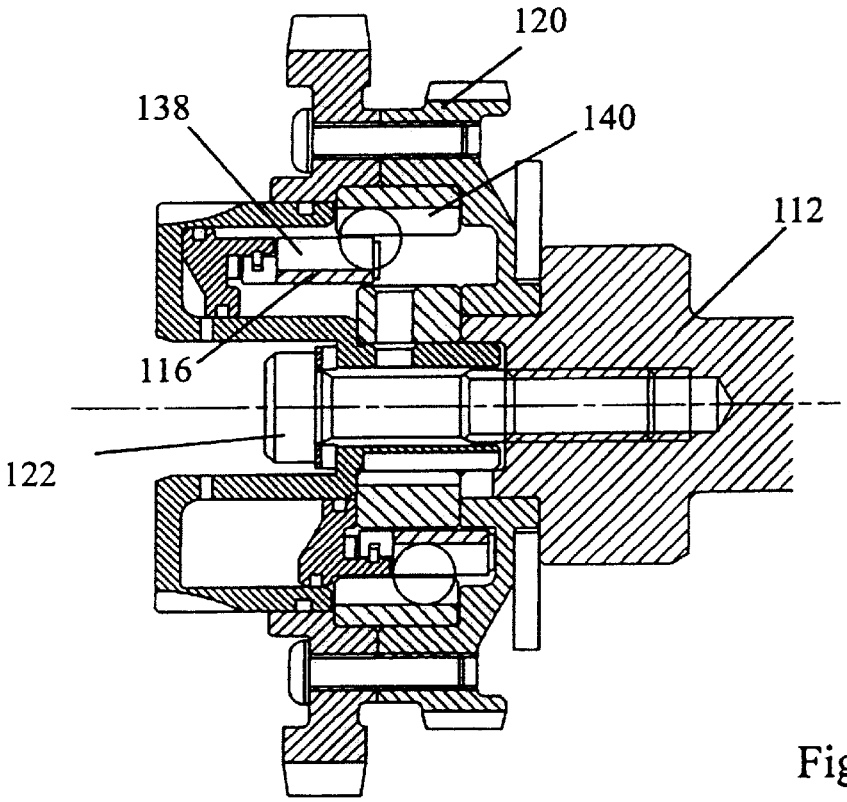
FIG. 8 is an axial section through the embodiment of FIG. 7 in a plane passing through the outer set of balls and showing the balls, the intermediate member and the piston in their extreme positions.

Each of the sections of FIGS. 7 and 8 is in two parts with the upper part of each drawing showing the piston 156 in its position of minimum displacement and the lower part showing the piston 156 at maximum displacement, the positions corresponding to the limits of phase adjustment of the coupling. As the piston 156 moves, the point of intersection of the helical grooves of the intermediate member 116 and those of the inner and outer member 114, 118 also moves axially and the coupling balls move automatically to the position of the intersection, thereby altering the relative angular displacement of the inner and outer members. At all times, the two sets of balls are under radial pressure and it is this clamping of the balls that eliminates backlash.

It is an important advantage of the described preferred embodiments of the invention that the steps taken to eliminate backlash result only in an increase in rolling friction rather than sliding friction. This not only reduces the overall operating friction level but is also less prone to wear.

The person skilled in the art will appreciate that various modifications may be made to the above described embodiment of the invention without departing from the scope of the invention as set out in the appended claims.

What is claimed is:

1. A variable phase coupling for connecting a crankshaft to a camshaft, the coupling comprising a drive member for connection to the crankshaft having helical grooves of a first pitch, a driven member for connection to the engine camshaft having helical grooves of a different pitch facing towards the grooves in the drive member, an intermediate member disposed between the drive and driven members having helical grooves on its inner and outer surfaces, a first set of balls engaging in the pairs of helical grooves comprising the helical grooves in the driven member and the facing grooves on one surface of the intermediate member, a second set of balls engaging in the pairs of helical grooves that comprise the grooves in the drive member and the facing grooves on the other surface of the intermediate member, and means for axially displacing the intermediate member relative to the drive and driven members, the displacement of the intermediate member serving to move the balls relative to the helical grooves in the drive and driven members so as to vary the phase between the drive and driven members, wherein the helical grooves in each pair have the same pitch as one another and, in order to reduce backlash, the intermediate member is radially compliant and exerts a slight clamping force on the balls.

2. A variable phase coupling as claimed in claim 1, wherein the helical grooves in the drive member and the driven member have opposite pitch.

* * * * *